US011224260B2

(12) United States Patent
Inouye

(10) Patent No.: US 11,224,260 B2
(45) Date of Patent: Jan. 18, 2022

(54) REMOVABLE (AND OPTIONALLY WASHABLE) HAT INSERT FOR ABSORBING PERSPIRATION

(71) Applicant: Russ Inouye, Kaneohe, HI (US)

(72) Inventor: Russ Inouye, Kaneohe, HI (US)

( * ) Notice: Subject to any disclaimer, the term of this patent is extended or adjusted under 35 U.S.C. 154(b) by 29 days.

(21) Appl. No.: 16/523,917

(22) Filed: Jul. 26, 2019

(65) Prior Publication Data

US 2020/0154808 A1 May 21, 2020

Related U.S. Application Data

(60) Provisional application No. 62/770,015, filed on Nov. 20, 2018.

(51) Int. Cl.
*A42C 5/02* (2006.01)
*A42B 1/008* (2021.01)
*A42B 3/10* (2006.01)

(52) U.S. Cl.
CPC ..... *A42C 5/02* (2013.01); *A42B 1/008* (2013.01); *A42B 3/10* (2013.01)

(58) Field of Classification Search
None
See application file for complete search history.

(56) References Cited

U.S. PATENT DOCUMENTS 1,366,890 A * 1/1921 Dehle ..... A42B 7/00 2/181
1,867,949 A * 7/1932 Molins ..... B65D 85/1063 206/256
1,986,312 A * 1/1935 Wilson ..... A42C 5/02 2/63
1,997,017 A * 4/1935 Roeloffzen ..... A42C 5/02 2/182.8
2,001,238 A * 5/1935 Eli ..... A45D 6/08 132/244
2,003,886 A * 6/1935 Hoffeld ..... A42B 1/069 2/181
2,042,567 A * 6/1936 Trieschmann ..... A41B 7/12 2/60
2,101,997 A * 12/1937 Goldberg ..... A45C 3/06 150/117

(Continued)

*Primary Examiner* — Jocelyn Bravo
(74) *Attorney, Agent, or Firm* — John C. Pokotylo; Pokotylo Patent Services

(57) ABSTRACT

The challenge of protecting caps from excess perspiration is solved by providing a hat liner comprising: (a) a first portion including a plurality of tabs separated by one or more gaps, the first portion dimensioned so that at least a part of it fits between, and is held by, the sweatband of a cap and one or more front panels of a hat; and (b) a second portion, directly or indirectly joined with the first portion along a length, and including at least one moisture absorbing layer. The second portion may further include at least one moisture wicking layer. The first portion may include at least three tabs defined and separated by at least two gaps. At least some of the two gaps may have a wider open end and a narrower closed end. Each of the plurality of tabs in the first portion may be provided with a plurality of lateral ridges. The second portion may be indirectly joined with the first portion via the hinge portion. The hinge portion is provided with a plurality of lateral slits.

14 Claims, 10 Drawing Sheets

(56) References Cited

U.S. PATENT DOCUMENTS 2,103,203 A * 12/1937 Jolly ..... B42F 7/00 206/215
2,106,075 A * 1/1938 Tabley ..... A42C 5/02 2/181
2,138,460 A * 11/1938 Ringler ..... B65D 5/5206 206/45.25
2,144,870 A * 1/1939 Bullard ..... A42B 3/14 2/410
2,351,132 A * 6/1944 Kling ..... A42C 5/02 2/181
2,439,984 A * 4/1948 Pearson ..... A42C 5/02 2/181
2,442,008 A * 5/1948 Kagan ..... A41D 27/26 2/268
2,445,209 A * 7/1948 Clark ..... A42C 5/02 2/181.4
2,585,896 A * 2/1952 Hoffman ..... A42C 5/02 2/184
2,654,470 A * 10/1953 Borucki ..... B65D 5/5007 206/783
2,721,687 A * 10/1955 Gross ..... B65D 5/68 229/120.1
2,777,627 A * 1/1957 Crane ..... B65D 5/4802 206/510
2,932,438 A * 4/1960 Smith ..... B65D 5/12 206/320
2,994,090 A * 8/1961 Ostwald ..... A42C 5/02 2/182.1
3,062,426 A * 11/1962 Mason ..... B65D 5/0281 229/117.16
3,129,872 A * 4/1964 Lutwack ..... B42F 7/02 229/72
3,138,293 A * 6/1964 Roak ..... B65D 75/5877 222/105
3,155,982 A * 11/1964 Baratelli ..... G02C 5/146 2/12
3,164,842 A * 1/1965 Weinstein ..... A42B 1/061 2/195.2
3,189,249 A * 6/1965 Fallert ..... B65D 5/0281 229/185
3,216,645 A * 11/1965 Hemann ..... B65D 5/46016 229/117.13
3,315,273 A * 4/1967 Bullard ..... A42B 1/08 2/418
3,578,736 A * 5/1971 Dootson ..... A42C 5/02 2/181
3,613,114 A * 10/1971 Hill et al. ..... A42B 3/10 2/416
3,643,856 A * 2/1972 Jones ..... B65D 5/566 229/122.33
4,317,238 A * 3/1982 Amin ..... A42B 1/208 2/12
4,368,545 A * 1/1983 Seidman ..... A45D 44/12 2/174
4,406,021 A * 9/1983 Bloom ..... A42C 5/02 2/181
4,468,817 A * 9/1984 Nunnery ..... A42B 3/10 2/181
4,630,317 A * 12/1986 Brown ..... A41D 20/00 2/12
4,698,852 A * 10/1987 Romero ..... A42B 3/00 2/171
4,790,034 A * 12/1988 Pass ..... A42B 1/061 2/195.5
4,829,599 A * 5/1989 Giorgio ..... A42B 3/105 2/414
4,833,734 A * 5/1989 Der Estephanian ... A41D 20/00 2/170
4,845,785 A * 7/1989 Allen ..... A41D 27/26 2/268
4,850,054 A * 7/1989 Sutton ..... A42B 1/208 2/10
4,852,186 A * 8/1989 Landis ..... A41D 13/1184 2/9
4,856,116 A * 8/1989 Sullivan ..... A41D 20/00 2/181
4,856,117 A * 8/1989 Goldman ..... A42B 1/201 2/195.5
4,858,247 A * 8/1989 Hooser ..... A42B 1/002 2/181.4
4,920,576 A * 5/1990 Landis ..... A41D 13/1184 2/9
4,941,210 A * 7/1990 Konucik ..... A41D 27/13 2/171
RE33,430 E * 11/1990 Nunnery ..... A42B 3/10 2/181
5,003,640 A * 4/1991 Pizzacar ..... A42B 1/248 2/181.4
5,025,504 A * 6/1991 Benston ..... A42B 3/10 2/181.4
5,088,126 A * 2/1992 Mathis ..... A42B 3/10 2/181
5,156,265 A * 10/1992 Platt ..... B65D 5/5206 206/45.25
5,269,026 A * 12/1993 McManus ..... A42B 1/08 2/195.2
5,287,559 A * 2/1994 Christiansen ..... A42B 1/248 2/181
5,313,668 A * 5/1994 Bogan ..... A42C 5/02 2/181.4
5,323,754 A * 6/1994 Pittman ..... F41B 5/1469 124/35.1
5,426,790 A * 6/1995 Robertson ..... A61F 11/06 2/209.13
5,442,817 A * 8/1995 Miner ..... A42B 1/248 2/181.4
5,481,760 A * 1/1996 Wood, Jr. ..... A42B 1/061 2/181.4
5,484,392 A * 1/1996 Sydor ..... A47B 21/0371 2/255
5,553,326 A * 9/1996 Moore ..... A41D 20/00 2/181
5,566,395 A * 10/1996 Nebeker ..... A42C 5/02 2/181
5,600,855 A * 2/1997 Ramirez ..... A42B 1/22 2/181.4
D392,443 S * 3/1998 Preddy ..... D2/894
D393,935 S * 5/1998 Hines ..... D2/865
5,826,279 A * 10/1998 Tencer ..... A42B 3/10 2/181
5,920,910 A * 7/1999 Calvo ..... A42C 5/02 2/181
5,987,649 A * 11/1999 Robertson ..... A42B 1/061 2/181
6,009,555 A * 1/2000 Siprut ..... A42B 1/247 2/12
6,061,827 A * 5/2000 Lampson ..... A41B 13/10 2/49.1
6,108,818 A * 8/2000 Eisenberg ..... A41D 20/00 2/181.2
6,138,280 A * 10/2000 Bae ..... D04H 1/4374 2/181
6,332,223 B1 * 12/2001 Le Gette ..... A61F 11/14 128/857
6,341,377 B1 * 1/2002 Faries, Jr. ..... A41D 27/13 2/53
6,467,095 B1 * 10/2002 Nunnery ..... A42B 3/10 2/181
6,546,563 B2 * 4/2003 Young ..... A42B 1/22 2/181
6,567,991 B1 * 5/2003 Holslag ..... A41D 20/00 2/171
6,584,984 B2 * 7/2003 Kelly ..... A45D 8/36 132/212
6,875,437 B2 * 4/2005 Yanovsky ..... A45D 44/12 2/171
6,923,779 B1 * 8/2005 Choiniere ..... A61F 5/028 2/311

(56) References Cited

U.S. PATENT DOCUMENTS 6,928,660 B2 * 8/2005 Park ..... A42C 5/02 2/181
6,966,074 B2 * 11/2005 Huh ..... A42B 3/14 2/181.4
7,152,251 B2 * 12/2006 Yan ..... A42B 1/064 2/195.6
7,278,173 B2 * 10/2007 Turner ..... A42B 1/06 2/181
7,673,350 B2 * 3/2010 Mazzoccoli ..... A42B 3/003 2/411
D621,099 S * 8/2010 Johnson ..... D29/122
7,941,870 B2 * 5/2011 Kingto ..... A42C 5/02 2/181.4
7,966,673 B1 * 6/2011 Gibson ..... A42B 1/08 2/425
D660,555 S * 5/2012 Stoltz ..... D2/892
D661,028 S * 5/2012 Hollingsworth ..... D29/122
8,393,014 B1 * 3/2013 Follo ..... A42C 5/02 2/181
8,869,314 B2 * 10/2014 Peper ..... A41F 15/00 2/336
8,904,567 B2 * 12/2014 Johnson ..... A42B 3/10 2/181.4
9,009,869 B1 * 4/2015 Shapiro ..... A41D 31/00 2/181
9,456,650 B1 * 10/2016 Boyce ..... A41D 20/00
D770,147 S * 11/2016 Byrd ..... D2/891
10,212,985 B1 * 2/2019 Yang ..... A42C 5/02
2002/0100107 A1 * 8/2002 Shin ..... A42C 5/02 2/181
2005/0034214 A1 * 2/2005 Nunnery ..... A42C 5/02 2/181
2005/0223475 A1 * 10/2005 Turner ..... A42B 1/062 2/209.4
2006/0176660 A1 * 8/2006 Amiri ..... G06F 1/1615 361/679.09
2006/0191050 A1 * 8/2006 Papac ..... A61F 9/045 2/12
2007/0245453 A1 * 10/2007 Dolenak ..... A41D 19/01529 2/161.6
2007/0245457 A1 * 10/2007 Gelera ..... A42C 5/02 2/181
2008/0092262 A1 * 4/2008 James Carr ..... A41D 19/0062 2/16
2008/0301854 A1 * 12/2008 Kingto ..... A42C 5/02 2/181
2009/0222975 A1 * 9/2009 Green ..... A42C 5/02 2/410
2010/0095430 A1 * 4/2010 Higgins ..... A42C 5/02 2/181.2
2010/0108750 A1 * 5/2010 Coleman, Jr. ..... B65D 5/6658 229/200
2010/0132092 A1 * 6/2010 Temblador ..... A42B 1/008 2/182.8
2010/0307931 A1 * 12/2010 Waters ..... A42B 1/244 206/8
2011/0191937 A1 * 8/2011 Wang ..... D03D 3/005 2/181
2011/0191938 A1 * 8/2011 Elliott ..... A42C 5/02 2/181.2
2012/0036613 A1 * 2/2012 Calon ..... A42C 5/02 2/171
2013/0111648 A1 * 5/2013 Huh ..... A42B 3/14 2/181
2013/0174322 A1 * 7/2013 Williams ..... A42B 1/208 2/181
2013/0239299 A1 * 9/2013 Carter-Cohen ..... A45F 5/00 2/300
2013/0247281 A1 * 9/2013 Zebouni ..... A42C 5/02 2/272
2015/0020290 A1 * 1/2015 Yarbrough ..... A41B 3/06 2/129
2015/0272242 A1 * 10/2015 Bevier ..... A41D 19/01558 2/20
2016/0021962 A1 * 1/2016 Lacy ..... A42B 1/201 2/181
2017/0027269 A1 * 2/2017 Wilson ..... A42C 5/02
2017/0164677 A1 * 6/2017 Olivares Velasco ..... A42B 1/20
2017/0202286 A1 * 7/2017 Cowan ..... A41D 3/00
2017/0354191 A1 * 12/2017 Maring ..... A41D 20/00
2019/0133224 A1 * 5/2019 McKonly ..... A41D 20/00
2020/0107601 A1 * 4/2020 Schlam ..... A42B 1/008

* cited by examiner 100A
1"
1 3/8"
1 1/4"
8"
112
114
114
114
110
120

100B
1"
1 3/8"
1 1/4"
9"

100C
1"
1 3/8"
1 1/4"
10 1/2"

100D

100E

REMOVABLE (AND OPTIONALLY WASHABLE) HAT INSERT FOR ABSORBING PERSPIRATION

§ 0. RELATED APPLICATION(S)

This application claims the benefit of U.S. Provisional Patent Application Ser. No. 62/770,015 (referred to as "the '015 provisional" and incorporated herein by reference), filed on Nov. 20, 2018, titled "REMOVABLE (AND OPTIONALLY WASHABLE) HAT INSERT FOR ABSORBING PERSPIRATION" and listing Russell Inouye as the inventor. The present invention is not limited to requirements of the particular embodiments described in the '015 provisional.

§ 1. BACKGROUND OF THE INVENTION

§ 1.1 Field of the Invention

The present description concerns hats, such as baseball caps for example. In particular, the present description concerns protecting hats, and especially baseball caps, from damage caused by perspiration.

§ 1.2 Background Information

Baseball caps have become a popular collectable item. Some collectors have hundreds or even thousands of baseball caps. Given the actual or potential value of baseball caps, collectors often meticulously store their hat collection. However, much like a car collector who likes to take their vintage car out for a Sunday drive, baseball cap collectors enjoy wearing their caps out. Unfortunately, however, wearing a baseball cap can decrease its value. Besides avid collectors, even everyday baseball cap wearers want to preserve the look and fit of their caps.

Before further discussing protecting baseball caps (referred to as "caps"), the main components of a typical cap are introduced. The dome part of the cap is called the "crown." The crown is typically made by sewing together triangular panels. There are usually six panels—two front, two side, and two rear—but this can vary. For example, some caps have five panels, and some caps have up to eight panels. Crowns are different in "structured" and "unstructured" caps. More specifically, a structured cap has backing in the crown so that it holds its shape while it's on the wearer's head. An unstructured cap doesn't have a stiff backing, so the crown sits low and fits more to the shape of wearer's head. Buckram, a stiff woven fabric, may be used to reinforce the one or more crown panels (for example, the front two panels) of the crown. Buckram (or a like material) helps the front panels retain their shape, standing prominently upright. However, unstructured caps are designed for a more relaxed look (and a more pliable, relaxed fit), and may be made without the buckram. A button on the peak of the crown connects the panels together. The button is typically made from metal or plastic and covered in fabric.

For ventilation, caps may be provided with "eyelets" which are small holes. Eyelets can be holes in the fabric, bordered by a sewn edge, or they can be punched with small metal rivets. Typically, an eyelet may be provided in each dome panel. Alternatively, or in addition, caps may be provided with mesh back panels. Such caps are typically referred to as "trucker" caps.

Regarding sizing, there are fitted caps, caps with adjustable closures (such as snap backs, and straps with hook and loop closures), and caps that feature a certain amount of stretch to comfortably accommodate a range of sizes.

The "visor" extends from the crown and is provided to shield the wearer's eyes from the sun or other harsh lighting. The visor is typically made from a stiff material (such as cardboard or plastic for example) and covered with fabric. The visor may have different designs on its upper and lower sides to provide a "sandwich" design effect. A visor may also be referred to as a "bill" or "brim." The visor may be curved or flat. If a new hat has a flat visor, a meticulous collector will want to ensure that the visor is not bent, and retains its flat profile.

For added comfort, a cloth "sweatband" lines the lower (base) inside edge of the crown where it touches the head and completely circles the inside of the panels. In addition to adding comfort, the portion of the sweatband around the forehead helps to wick moisture away and to prevent sweat from dripping on the face of the wearer.

Unfortunately, for some wearers and/or in some climates, the typical cloth sweatband is insufficient. Indeed, excess perspiration can wick from the sweatband to the front and/or side panels of the cap. Given the chemical components of perspiration, excess perspiration can permanently discolor the fabric of front and/or side panels, and even the fabric of the visor. This is an annoyance for everyday cap wearers, and can ruin an otherwise mint condition cap, or degrade the value of a cap.

Therefore, there is a need to protect caps (especially, their front panels, side panels, and/or visors) from excess perspiration.

U.S. Pat. No. 8,904,567 (referred to as "the Johnson patent" and incorporated herein by reference) concerns a hat or helmet liner that absorbs perspiration and prevents perspiration from dripping onto an athlete's face. The hat or helmet liner in the Johnson patent uses an adhesive backing to affix the liner to the inside front of the hat or helmet. If provided in a cap, the liner in the Johnson patent covers the front of the sweatband and extends up the front panels, without covering eyelets. The liner includes a moisture wicking layer, a liquid absorbent core layer, a liquid impervious layer, an adhesive layer comprising a repositionable pressure-sensitive adhesive, and a removeable release liner layer. In order to use the liner, the removable release liner layer is peeled from the adhesive layer and the liner is then applied to interior surfaces of a helmet or cap.

Unfortunately, the liner in the Johnson patent is intended to be disposable, which is environmentally unfriendly, and can become costly. Further, the use of adhesive can make fitting the liner in the hat tricky, and limits the ability to wash and reuse the liner since the strength of the adhesive will decrease with reuse and/or washing. Finally, relying only on adhesive hold the liner in place may be insufficient in some scenarios.

Therefore, there is a need to protect caps (especially, their front panels, side panels, and/or visors) from excess perspiration, and the solution should preferably be reusable and not solely rely on adhesive for proper positioning.

§ 3. SUMMARY OF THE INVENTION

The challenge of protecting caps from excess perspiration is solved by providing a hat liner comprising: (a) a first portion including a plurality of tabs separated by one or more gaps, the first portion dimensioned so that at least a part of it fits between, and is held by, the sweatband of a cap and one or more front panels of a hat; and (b) a second portion, directly or indirectly joined with the first portion along a length, and including at least one moisture absorbing layer.

In some example embodiments of the hat liner, the second portion further includes at least one moisture wicking layer.

In some example embodiments of the hat liner, the first portion and/or the second portion has a length of between about (or roughly) 8" and about (or roughly) 10½".

In some example embodiments of the hat liner, the first portion has a width which is less than a width of the second portion.

In some example embodiments of the hat liner, the first portion includes at least three tabs defined and separated by at least two gaps. In some such embodiments, at least some of the two gaps have a wider open end and a narrower closed end. For example, at least some of the at least two gaps may be V-shaped.

In some example embodiments of the hat liner, each of the plurality of tabs in the first portion is provided with a plurality of lateral ridges. In some such embodiments, the plurality of lateral ridges may be compression molded, closed-cell foam. In some example embodiments of the hat liner, each of the plurality of lateral ridges may be about (or roughly) 0.5 mm thick.

In some example embodiments of the hat liner, the second portion is indirectly joined with the first portion via the hinge portion. In some such embodiments, the hinge portion is provided with a plurality of lateral slits. In some such embodiments, the plurality of tabs provided in the first portion includes two outer tabs and at least one inner tab, sections of the hinge, each adjacent to a respective one of the two outer tabs, each includes a lateral slit of a first length, a section of the hinge adjacent to each of the at least one inner tab includes at least two lateral slits of a second length separated by a narrow span, and the second length is shorter than the first length.

§ 3. BRIEF DESCRIPTION OF THE DRAWINGS

Figure 6B:
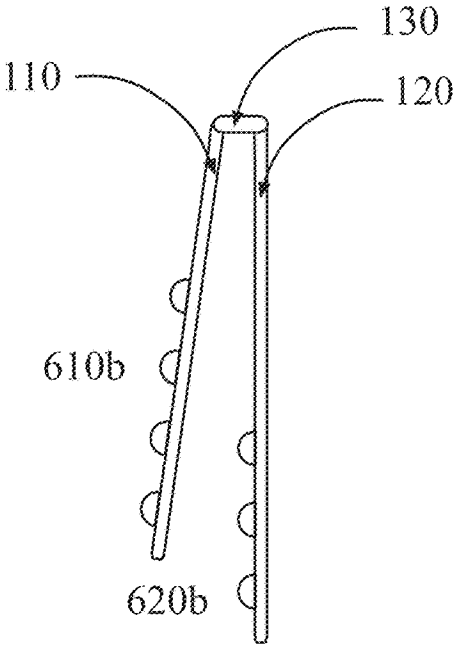
Figure 6A:
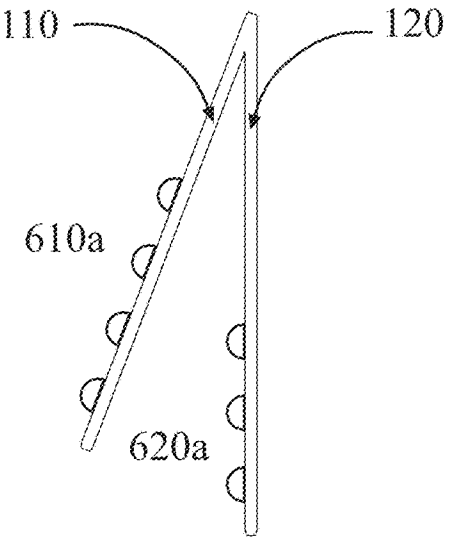
Figure 6C:
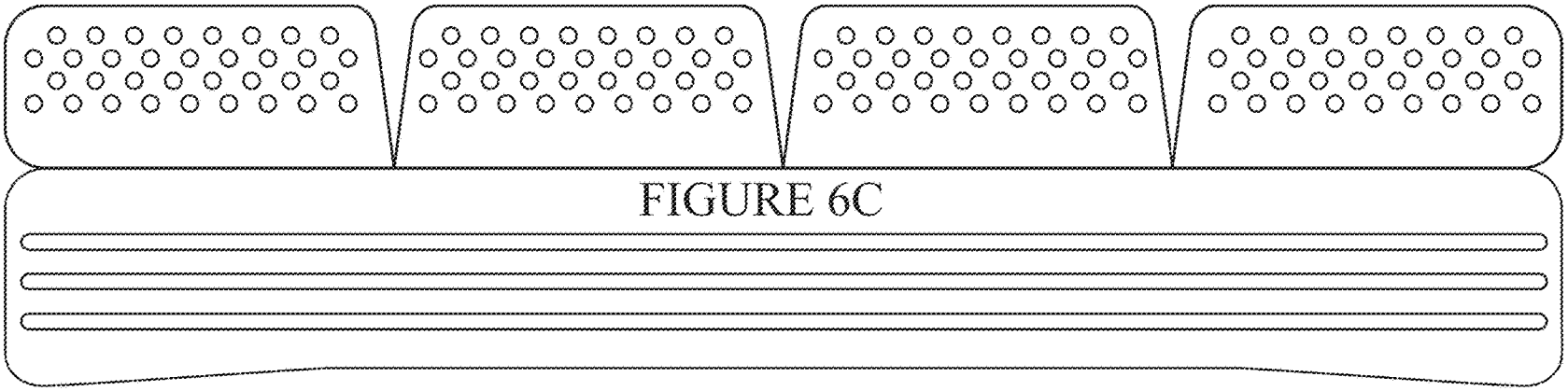
Figure 6D:
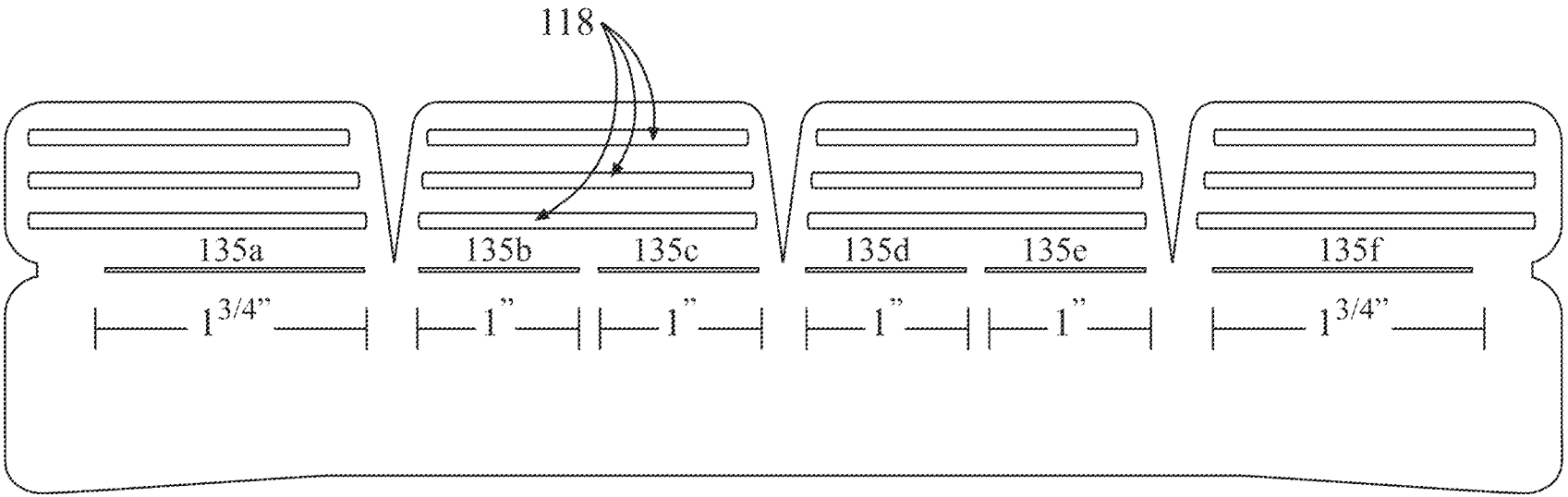

FIGS. 6A and 6B are cross-sectional views of alternative designs of first and second portions of a liner, and FIG. 6C is a plan view of a liner, provided with rubber (e.g., silicon, compression molded closed foam, etc.) dots and/or ridges, while FIG. 6D is a plan view of a liner provided with (e.g., silicon, compression molded closed cell foam, etc.) lateral ridges, consistent with the present description.

§ 4. DETAILED DESCRIPTION

Figures 1A, 1B, 1C:
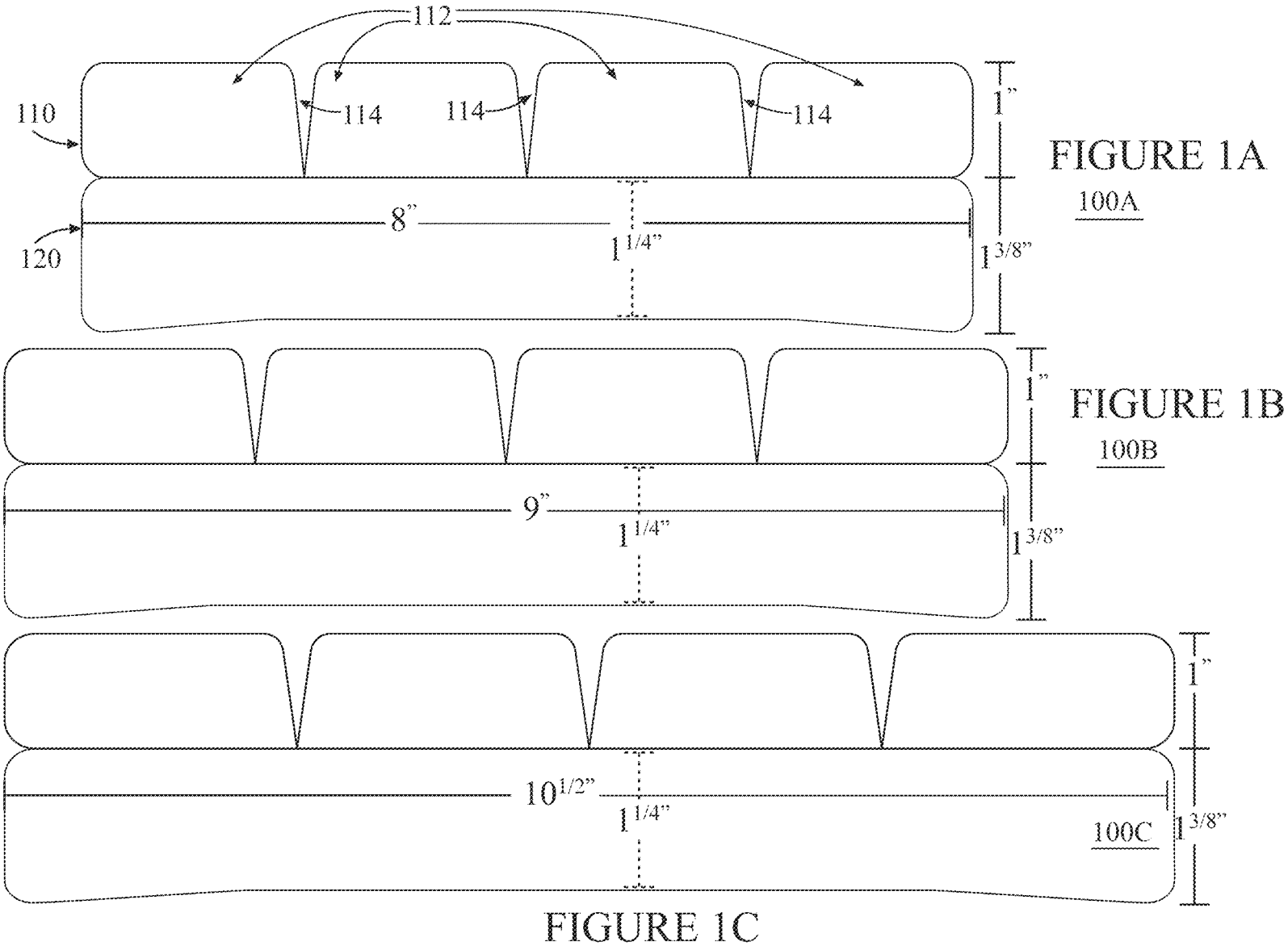
FIGS. 1A-1D illustrate small, medium, large, and universal sized liners consistent with the present description.
Figure 1D:
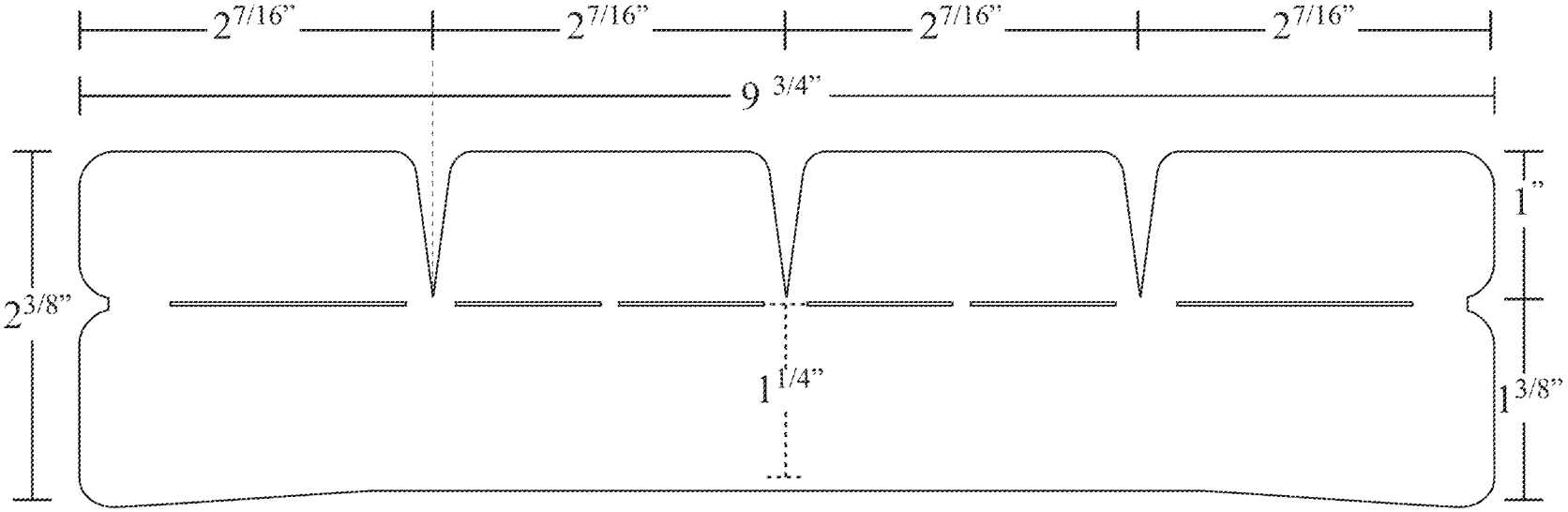
Figure 1E:
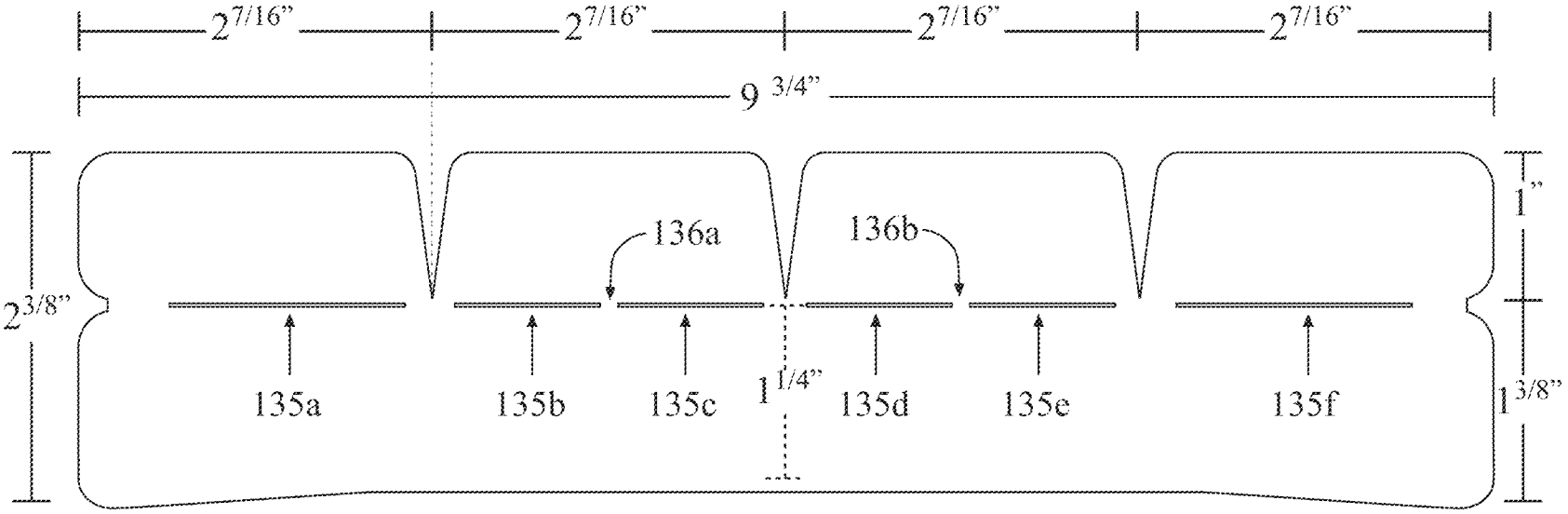
FIG. 1E illustrates a universal sized liner provided with slits at a hinge.

FIGS. 1A-1D are small 100A, medium 100B, large 100C, and universal 100D sized liners consistent with the present description. FIG. 1E illustrate a universal sized liner 100E provided with slits 135*a*-135*f* In each case, the liner includes first portion 110 and a second portion 120. The first portion 110 and second portion 120 are intended to be hinged with respect to each other so that they may be folded together, or almost together. Alternatively, as shown in the cross-sectional view of FIG. 2A, the first portion 110 and second portion 120 may be joined at one end and form very small angle θ (where θ<ten degrees and preferably less than five degrees). Alternatively, as shown in the cross-sectional view of FIG. 2B, the first portion 110 and second portion 120 may be joined at one end via a third (hinge) portion 130.

As shown in FIG. 1E, the hinge portion 130 may be provided with a plurality of lateral slits 135*a*-135*f*. Each of the lateral slits is about (or roughly) 1/32" wide. Each of the longer lateral slits 135*a* and 135*f* is about (or roughly) 1.75" long, while each of the shorter lateral slits 135*b*-135*e* is about (or roughly) 1.0" long. The lateral slits 135*a*-135*f* help the liner to fold and fit into a hat. Holes can be provided in addition to, or instead of, the lateral slits. However, providing holes instead of lateral slits makes it more difficult to remove waste material during manufacturing. Providing two shorter lateral slits (e.g., 135*b* and 135*c*, or 135*d* and 135*e*) instead of a longer lateral slit helps with fitting as the spans 136*a* and 136*b* help prevent the center portions of otherwise longer lateral slits from separating excessively when inserted into a hat.

Figure 3A:
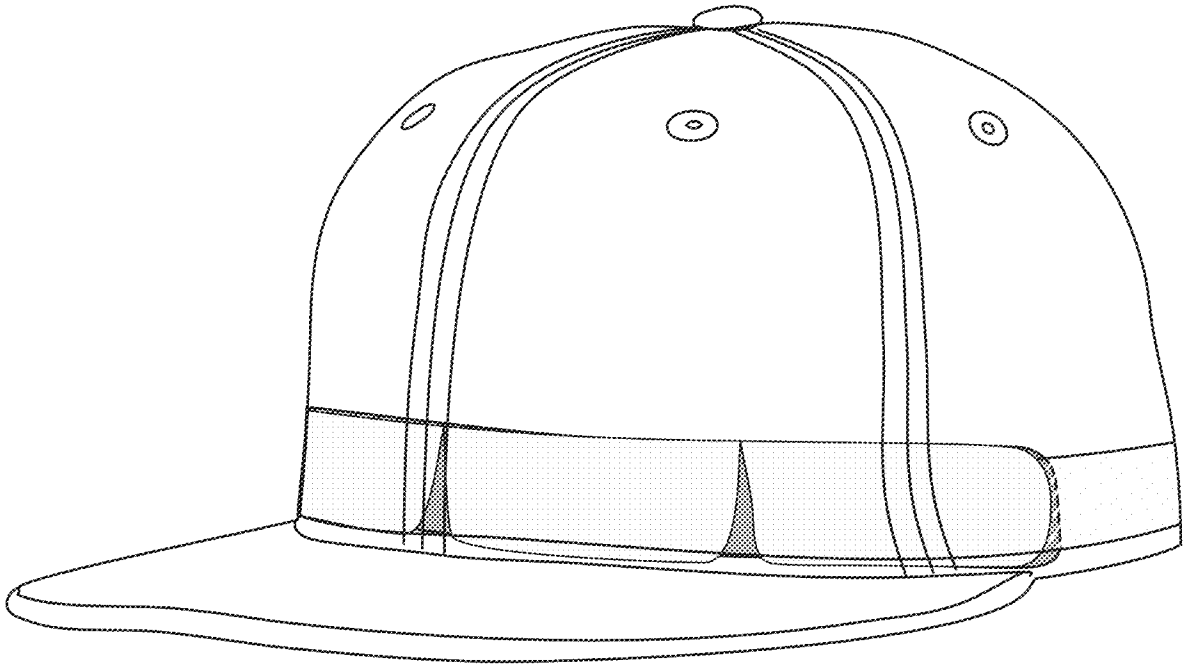
FIGS. 3A and 3B are alternative front perspective semi-transparent view of a hat liner consistent with the present description provided within a cap.
Figure 3B:
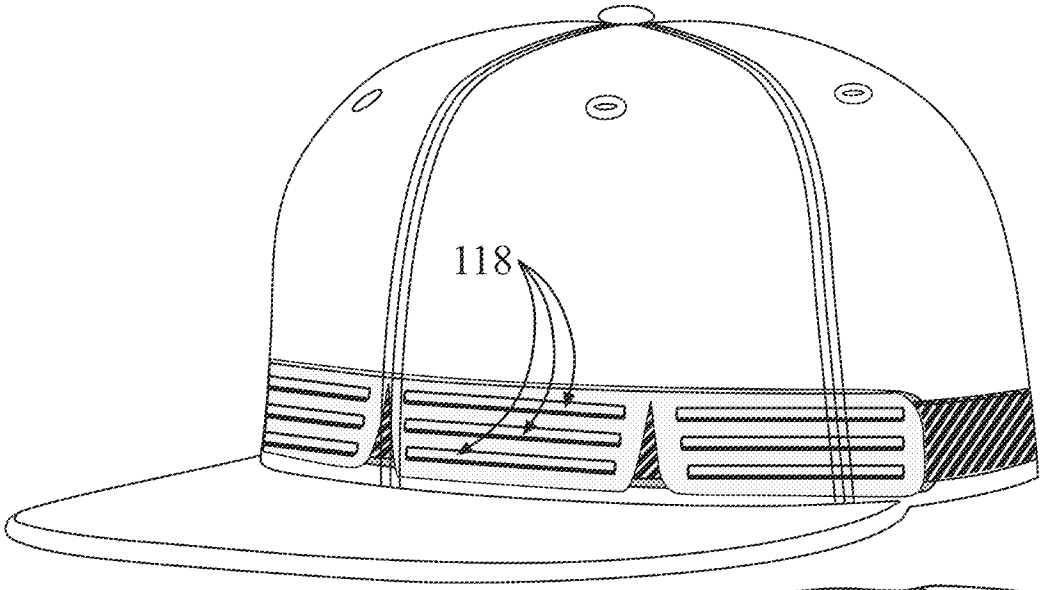

Referring back to FIGS. 1A-1E, the first portion 110 may include a plurality of tabs 112, each of which is separated by a V-shaped gap 114. Although the number of tabs (N) is shown as four in each of FIGS. 1A-1E, the number can range from as little as one (1) tab to as many of eight (8) tabs. Fewer, longer, tabs may be used if the first portion 110 is made from a more flexible material, and/or with a thickness that imparts more flexibility. If the first portion 110 is made from a less flexible material and/or with a thickness that imparts less flexibility, a greater number of shorter tabs may be used. The number of V-shaped gaps 114 is one less (N−1) than the number (N) of tabs 112. (Note that if there is only one tab, there will be no gaps or slits.) Although the gaps 114 are depicted as V-shaped, this is not necessary. However, the gaps 114 should narrow from the open end to the closed end. Further, although the gaps are shown as extending from one edge of the first portion 110 to the opposite edge, the gaps need not extend so far. In some example embodiments consistent with the present description, a combination of a gap and a slit (not shown) is provided in the first portion. In such example embodiments, the gap narrows to the slit, and the slit may extend to the edge of the first portion 110. Referring to FIGS. 3A and 3B, the gaps 114 and/or slits (not shown) are provided to facilitate the insertion of the first portion 110 in the space between panel(s) and the sweatband of the cap.

The first portion 110 may be made from a flexible plastic sheet or laminate, such as polyethylene terephthalate (PETE or PET), high-density polyethylene (HDPE), polyvinyl chloride (PVC), low-density polyethylene (LDPE), or polypropylene (PP) for example. Alternatively, the first portion 110 may include (for example, as one or more layers, and/or be impregnated with) such a plastic(s). As shown in FIGS. 3A and 3B, the first portion 110 is intended to fit between the sweatband and one or more panels of the cap. For example, the first portion may extend entirely across two front panels and partially extend into two side panels.

Figure 2A:
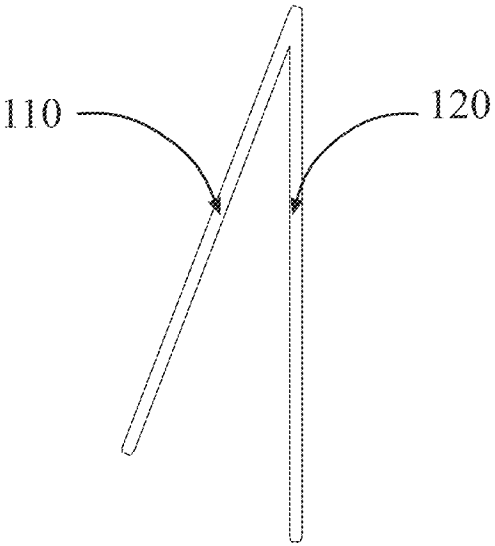
Figure 3C:
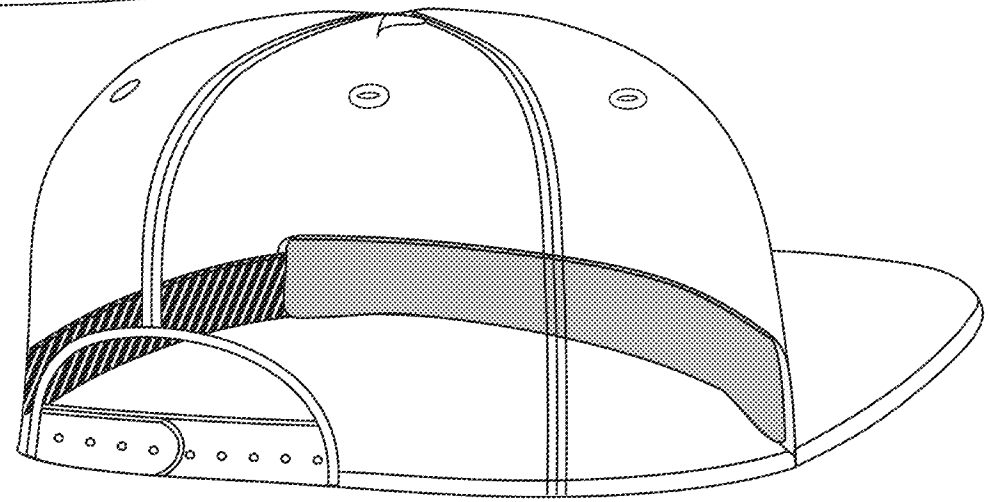
FIG. 3C is a rear perspective semi-transparent view of a hat liner consistent with the present description, such as those in FIGS. 3A and 3B, provided within a cap.

The second portion 120 may be made from a moisture absorbing material, such as fabric, neoprene, neoprene, terry cloth, microfiber, cotton polymer, cotton, polyester, a blend of one or more of the preceding, and the like. The second portion may have multiple layers to wick and/or hold moisture. Referring back to FIG. 2A the first portion 110 and a layer of the second portion 120 may be made from the same material (e.g., sheet plastic). The material may be formed from a single (e.g., compression molded closed cell foam) sheet and bent, or made from one or two sheets and fused together, or otherwise joined (e.g., stitched, adhered, etc.). If the second portion 120 has a layer formed from the same material as the first portion, additional layers should be provided between any non-moisture absorbing layers and the cap wearer's forehead. (See FIG. 3C.) The top edge of the second portion 120 should be straight, while the bottom edge of the second portion 120 may be straight or slightly curved as shown. Any moisture absorbing layer of the second portion should be between 0.5 mm and 5.0 mm thick. The first portion 110 may be the same material as the second portion, but without closed cell foam in between fabrics that are compression molded together and glued (which allows the two materials to bond).

The second portion 120 may be provided as a single material, or multi-layer laminate. One or more layers may be formed from non-woven materials including, for example, non-woven wood, wood pulp fibers, paper or non-woven absorbent polymeric fibers, or the like. One or more layers may be made from a perforated non-woven material (for example, spunlace) One or more of the layers may be a moisture-barrier layer to prevent sweat from the liner from wicking to the sweatband, panels, and/or visor of the cap.

Figure 2C:
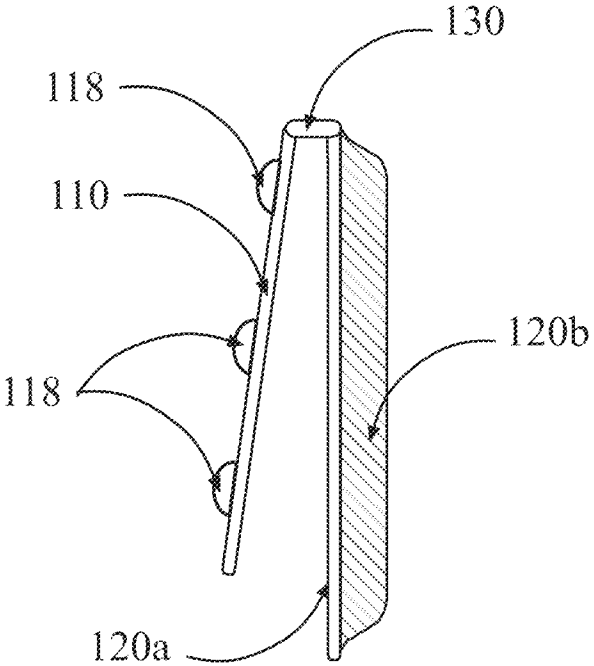
FIGS. 2A-2C are cross-sectional views of alternative designs of first and second portions of a liner consistent with the present description.
Figure 2B:
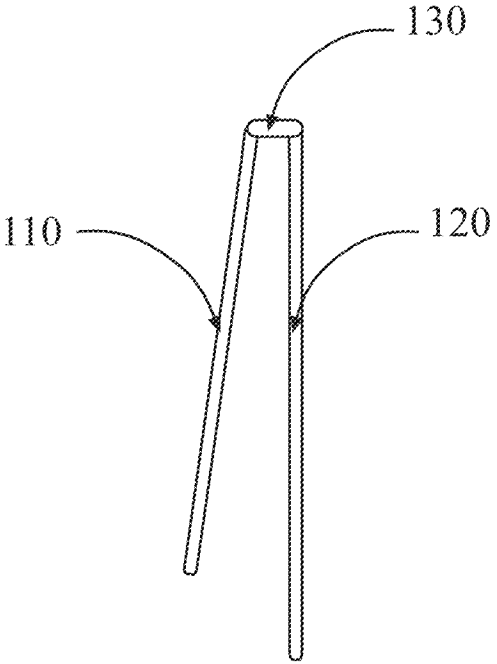
Figure 4B:
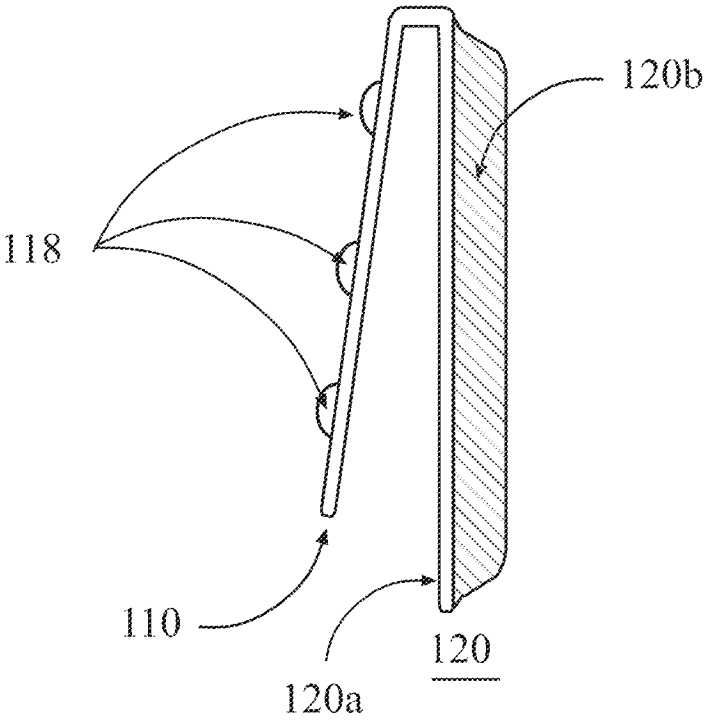
FIGS. 4A and 4B are cross-sectional views of alternative liners having a first portion and a multilayer (laminated) second portion.
Figure 4A:
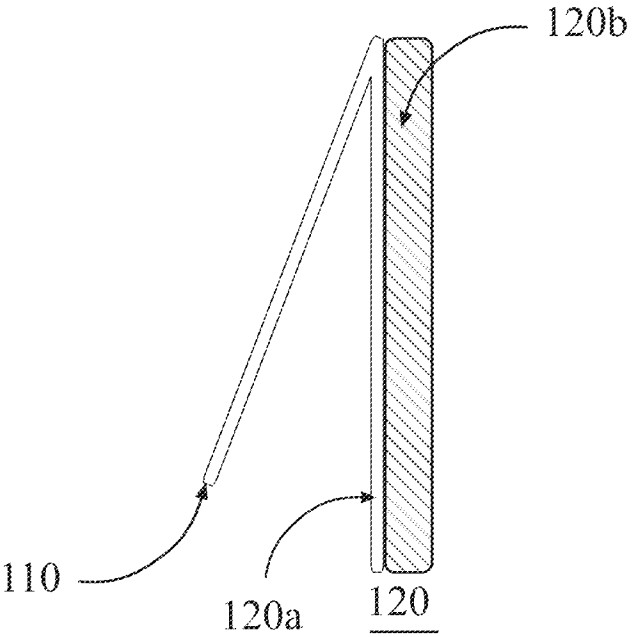
Figure 5B:
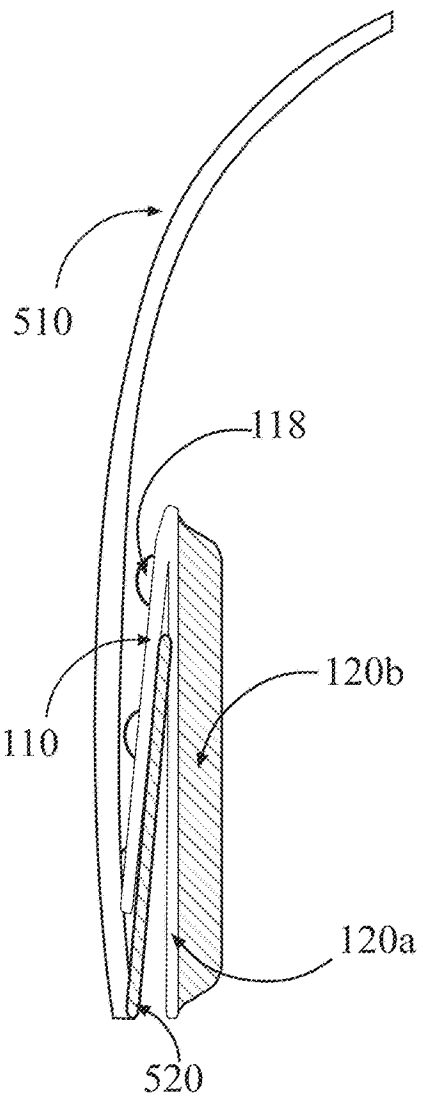
FIGS. 5A and 5B are cross-sectional views showing how alternative liners consistent with present description can fit between the panels and sweatband of a cap.
Figure 5A:
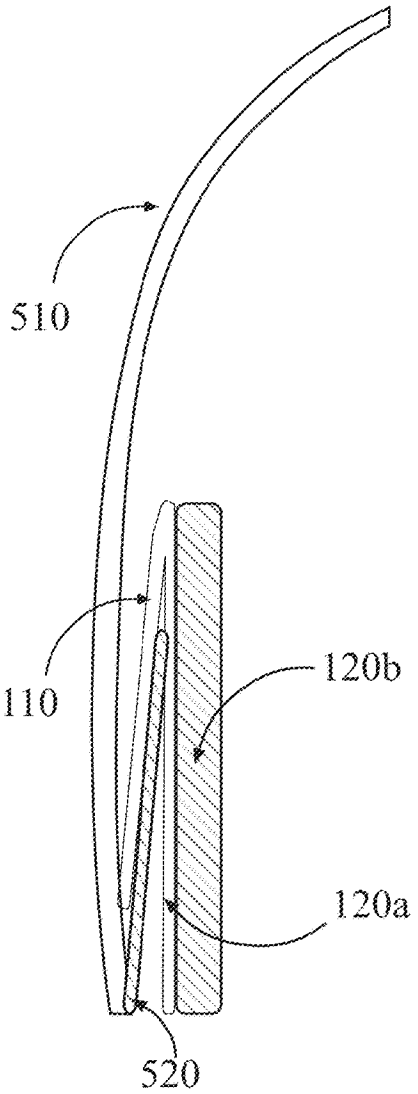

The first layer 110 and/or the second layer 120 made from, include a layer of, or be impregnated or otherwise provided with, a rubber, such as, for example, natural/isoprene rubber, ethylene propylene diene (EPDM), nitrile rubber (NBR), styrene butadiene rubber (SBR), silicone rubber, butyl rubber, polybutadiene, and the like. Referring to FIGS. 4A and 5A, in one example embodiment consistent with the present description, rubber (for example, provided as ridges or dots) may be provided on one or both sides of portion 110, and/or on the inside surface of portion 120. For example, silicon dots or ridges may be used to help hold the hat liner in place once inserted into the cap. The amount, texture and location of such rubber should be chosen to hold the hat liner in place, yet allow the hat liner to be inserted into the cap without too much flexing and/or sticking when inserting it. FIGS. 6A and 6B are cross-sectional views of alternative designs of first and second portions of a liner (Recall, e.g., FIGS. 2A and 2B.) provided with rubber (e.g., silicon) dots and/or ridges (610*a*, 610*b*, 620*a* and/or 620*b*) consistent with the present description. FIG. 6C is a plan view of a liner in which the tabs 112 are provided (on one or both sides) with dots and the second portion 120 is provided with ridges. FIGS. 3B, 4B, 5B and 6D are embodiments of a liner in which each of the tabs 112 is provided with a plurality of (e.g., three) lateral ridges 118. However, my invention may include any combination of rubber (or compression molded) dots and/or ridges on one or both sides of portion 110, and/or on the inside surface of portion 120. Referring to FIGS. 2C, 4B and 5B, the padding 120*b* may be about (or roughly) 1 mm thick, while the lateral ridges 118 may be about (or roughly) 0.5 mm thick. Both the padding 120*b* and the lateral ridges 118 may be formed from compression molded, closed-cell foam.

FIGS. 1A-1E provide dimensions (in units of inches) of small 100A, medium 100B, large 100C, and universal 100D sized liners, respectively. One or more of these dimensions may be adjusted (for example within ±10 percent). In alternative embodiments consistent with the present description, the widths of the first portion 110 and second portion 120 may be substantially greater than the 1" and 1⅜" dimensions shown. However, the width of the first portion 110 should be less than (for example, ⅜"±10 percent less than) the width of the second portion 120.

FIG. 4A is a cross-sectional view of a liner in which the first portion 110 and a layer 120*a* of a second portion 120 are made from the same material (e.g., a bent and/or fused plastic sheet), and in which the second portion 120 has one or more additional layers 120*b* (e.g., to transfer or wick perspiration and/or absorb perspiration). FIG. 4B is similar to FIG. 4A, but the first portion 110 is provided with lateral ridges 118.

FIG. 5A is a cross-sectional view showing how a liner consistent with present description can fit between the panels 510 and sweatband 520 of a cap. As shown, the first portion 110 is accommodated (and held) in a space between the panel 510 and the sweatband 520. The second portion 120 covers (or substantially, but not totally, covers) the sweatband 520. FIG. 5B is similar to FIG. 5A, but the first portion 110 is provided with lateral ridges 118.

My invention is not limited to the exact materials and dimensions described. The term "about" when referencing a dimension is intended to be the dimension+/−10 percent. The term "roughly" when referencing a dimension is intended to be the dimension+/−20 percent. My invention is intended to include about (or roughly) any dimension(s) shown on the drawings.

What is claimed is:

1. A cap liner comprising:

a) a first portion including a plurality of tabs separated by one or more gaps, the first portion dimensioned so that at least a part of the first portion is configured to fit between, and be held by, a sweatband of a cap and one or more front panels of the cap;

b) a second portion including at least one moisture absorbing layer; and c) a hinge portion, wherein the second portion is indirectly joined with the first portion via the hinge portion, wherein the hinge portion is provided with a plurality of lateral slits, wherein each of the plurality of tabs in the first portion is provided with a plurality of lateral ridges, wherein the plurality of tabs provided in the first portion includes two outer tabs and at least one inner tab, wherein the hinge includes two outer sections, each adjacent to a respective one of the two outer tabs, and at least one inner section, each adjacent to a respective one of the at least one inner tab, wherein the plurality of slits includes a plurality of outer slits each having a first length and a plurality of inner slits each having a second length, wherein each outer section of the hinge includes a respective outer slit of the plurality of outer slits, wherein each inner section of the hinge includes two respective inner slits of the plurality of inner slits, separated by a narrow span, and wherein the second length is shorter than the first length.

2. The cap liner of claim 1 wherein the second portion further includes at least one moisture wicking layer.

3. The cap liner of claim 1 wherein the first portion has a length of between about 8" and 10½".

4. The cap liner of claim 1 wherein the second portion has a length of between about 8" and 10½".

5. The cap liner of claim 1 wherein the first portion has a width which is less than a width of the second portion.

6. The cap liner of claim 1 wherein the plurality of tabs of the first portion include at least three tabs, wherein the one or more gaps includes at least two gaps, and wherein the at least three tabs are defined and separated by the at least two gaps.

7. The cap liner of claim 6 wherein at least some of the at least two gaps have a wider first end and a narrower second end.

8. The cap liner of claim 6 wherein at least some of the at least two gaps are V-shaped.

9. The cap liner of claim 1 wherein the second portion includes a layer of compression molded, closed-cell foam.

10. The cap liner of claim 9 wherein the second portion is about 1 mm thick.

11. The cap liner of claim 1 wherein each of the plurality of lateral ridges is compression molded, closed-cell foam.

12. The cap liner of claim 1 wherein each of the plurality of lateral ridges is about 0.5 mm thick.

13. A combination comprising:

a) a cap including a bill, a sweatband, and a plurality of panels, at least some of the plurality of panels arranged adjacent to the bill and defining front panels; and b) a cap liner including i) a first portion including a plurality of tabs separated by one or more gaps, the first portion dimensioned so that at least a part of the first portion fits between, and is held by, the sweatband of the cap and one or more of the front panels of the cap;

ii) a second portion including at least one moisture absorbing layer, and iii) a hinge portion, wherein the second portion is indirectly joined with the first portion via the hinge portion, wherein the hinge portion is provided with a plurality of lateral slits, wherein each of the plurality of tabs in the first portion is provided with a plurality of lateral ridges, wherein the plurality of tabs provided in the first portion includes two outer tabs and at least one inner tab, wherein the hinge includes two outer sections, each adjacent to a respective one of the two outer tabs, and at least one inner section, each adjacent to a respective one of the at least one inner tab, wherein the plurality of slits includes a plurality of outer slits each having a first length and a plurality of inner slits each having a second length, wherein each outer section of the hinge includes a respective outer slit of the plurality of outer slits, wherein each inner section of the hinge includes two respective inner slits of the plurality of inner slits, separated by a narrow span, and wherein the second length is shorter than the first length.

14. A cap liner comprising:

a) a first portion including a plurality of tabs separated by one or more gaps, the first portion dimensioned so that at least a part of the first portion is configured to fit between, and be held by, a sweatband of a cap and one or more front panels of the cap, wherein the plurality of tabs provided in the first portion includes two outer tabs and at least one inner tab;

b) a second portion including at least one moisture absorbing layer; and c) a hinge portion through which the second portion is indirectly joined with the first portion, the hinge portion including 1) two outer sections, each being adjacent to a respective one of the two outer tabs, and each including a first plurality of lateral slits, each of the first of the plurality of lateral slits having a first length, and 2) at least one inner section, each being adjacent to a respective one of the at least one inner tab, and each including at least two lateral slits, each of the at least two lateral slits having a second length and being separated from an adjacent one of the at least two of the plurality of lateral slits by a narrow span, wherein the second length is shorter than the first length.

* * * * *